US005782660A

United States Patent [19]

Brickell et al.

[11] Patent Number: 5,782,660

[45] Date of Patent: Jul. 21, 1998

[54] WATERCRAFT PROPULSION SYSTEM

[75] Inventors: Joseph Brickell, Leawood, Kans.; Garland Martin, Jonesboro, Ark.; Daniel McDougal, Kansas City, Mo.

[73] Assignee: Innovative Material Systems, Inc., Olathe, Kans.

[21] Appl. No.: 814,348

[22] Filed: Mar. 11, 1997

[51] Int. Cl.[6] ..... B63H 19/00

[52] U.S. Cl. ..... 440/36; 440/91

[58] Field of Search ..... 56/8, 9; 440/3, 440/4, 5, 36, 90, 91, 92

[56] References Cited

U.S. PATENT DOCUMENTS

| | | | |
|---|---|---|---|
| 158,414 | 1/1875 | Heydrich . | |
| 193,511 | 7/1877 | Hetzler . | |
| 659,122 | 10/1900 | Bell . | |
| 675,201 | 5/1901 | Douglas . | |
| 726,213 | 4/1903 | Beer . | |
| 904,285 | 11/1908 | Thompson | 440/91 |
| 1,206,247 | 11/1916 | Ream | 440/36 |
| 1,716,607 | 6/1929 | Wardell . | |
| 1,905,162 | 4/1933 | Ensenat . | |
| 2,208,469 | 7/1940 | O'Brien . | |
| 2,578,535 | 12/1951 | Graci . | |
| 3,170,437 | 2/1965 | Kilmer . | |
| 3,486,253 | 12/1969 | Bruggeman . | |
| 3,540,194 | 11/1970 | Chaplin . | |
| 5,481,856 | 1/1996 | Wickoren et al. . | |

*Primary Examiner*—Stephen Avila

*Attorney, Agent, or Firm*—Hovey, Williams, Timmons & Collins

[57] ABSTRACT

A watercraft propulsion system is provided for maneuvering and positioning a dredge or weed harvesting craft in shallow waterways and includes a pair of booms positioned adjacent the port and starboard sides of the craft. Submersible and reversible motors are provided at the remote end of each pivotally mounted boom for independently driving wheels provided with a plurality of circumferentially spaced blades. The wheels include an enclosed buoyancy chamber to offset the weight of the wheels and the booms, and the blades are removable and may be provided in different configurations to accommodate different operating conditions. A pumping unit including a cutterhead is provided whereby the watercraft can perform dredging or aquatic weed harvesting operations.

11 Claims, 3 Drawing Sheets

WATERCRAFT PROPULSION SYSTEM

BACKGROUND OF THE INVENTION

1. Field of the Invention

The present invention broadly concerns a system for propelling a dredge or other shallow-water craft by independently operating wheels which are mounted for either surface propulsion or bottom-engaging drive. More particularly, the present invention is concerned with a combination drive including wheels carried by booms mounted on the port and starboard sides of the watercraft which may be independently raised and lowered and independently operated in a forward or reverse mode to propel and position the craft.

2. Description of the Prior Art

Moving watercraft about in shallow waterways such as ponds, lagoons and streams has taken different forms. Boats have used paddlewheels, inboard or outboard engines coupled to screws, oars or paddles or even poles to propel the craft along the water. A more challenging problem is presented when the watercraft is a dredge which includes a cutterhead to excavate the bottom of the waterway. The need to dig into the bottom with the cutterhead and the output forces on the discharge hose leading from the dredge is often so great as to make holding the craft by the propulsion examples listed above almost impossible. With large pumps and correspondingly large hoses leading from the dredge, the action of the water through the hose positions the craft, rather than the craft positioning the hose.

Another problem is presented when harvesting aquatic weeds such as water hyacinths. The tenacious nature of the weeds and the presences of large root masses with laterally extending roots, when coupled with the aforementioned problems of hose management when the weeds are pumped, complicates the problems of positioning and propelling the craft with screw drives engaging the water. This is especially true in shallow water situations where wind is a factor.

One solution heretofore employed in positioned dredges or weed harvesting equipment involves the use of winches connected by cable to the shore. By the use of multiple cables connected to the shore, the watercraft can be held in position. Unfortunately, this solution requires that the waterway be small or narrow, and involves considerable labor to erect and maintain the cable system during dredging or harvesting.

There has thus evolved a need for a new and improved dredge propulsion system which can be mounted on the watercraft and avoid the need for connection to the shore. There is further a need for a system for propelling watercraft in shallow water situations which will maintain the position of a dredge or weed harvester despite the engagement of the cutterhead with the bottom or weeds, the intake action of the pump, or the reaction thereto by the hose. Finally, there is needed a watercraft propulsion system which provides precise positioning in shallow water but is also capable of propelling and maneuvering the watercraft in waterways of any depth.

SUMMARY OF THE INVENTION

These objects have largely been met by the watercraft propulsion system of the present invention. The system hereof is readily adapted for addition to existing watercraft having the capability of powering a hydraulic pump, is economical to operate, and resists undesired drifting or movement of a watercraft such as a dredge during weed harvesting or dredging operations.

The present invention broadly includes a watercraft mounting port and starboard booms extending aft from the craft. The system further includes a wheel presenting a plurality of radially extending blades rotatably connected to each of the booms, with a drive motor connected for providing bidirectional rotation for each of the wheels, with each wheel driven independently. The craft is also provided with means for independently raising and lowering each of the booms to permit the wheels to either function against the water to paddle the craft from the surface or to engage the bottom and thereby push or pull the craft into a desired position.

More particularly, the craft hereof uses wheels which include mounts for independently and removably mounting the blades. The mounts may advantageously include plates which are oriented perpendicular to the axis of rotation to provide resistance to lateral movement of the dredge due to wind, current or other factors. The wheels may include a circumferentially extending buoyancy chamber which helps reduce the force necessary to lift the boom. The wheel presents a relatively wide rim from which the blades project to limit penetration of the boom into soft bottoms. When harder or denser bottoms are encountered, the blade may be provided with a penetrating point.

Advantageously, the wheels are independently driven, preferably by submersible hydraulic motors. The motors are each connected to their respective wheels by hubs which include shock absorbing couplers to reduce fatigue on the blades and other components when encountering underwater obstacles or rapid changes in speed or direction or rotation. The motors are carried at the remote end of the booms, which are preferably positioned opposite the forwardly extending cutterhead and pump. Thus, the wheels are normally in a pushing relationship to the cutterhead in either a raised or lowered position. Thus, when the cutterhead is cutting weeds or dredging a bottom surface, the trailing booms and wheels push the cutterhead into engagement.

These and other advantages of the present invention may be appreciated by reference to the drawing and the following description.

DESCRIPTION OF THE PREFERRED EMBODIMENT

Figure 1:
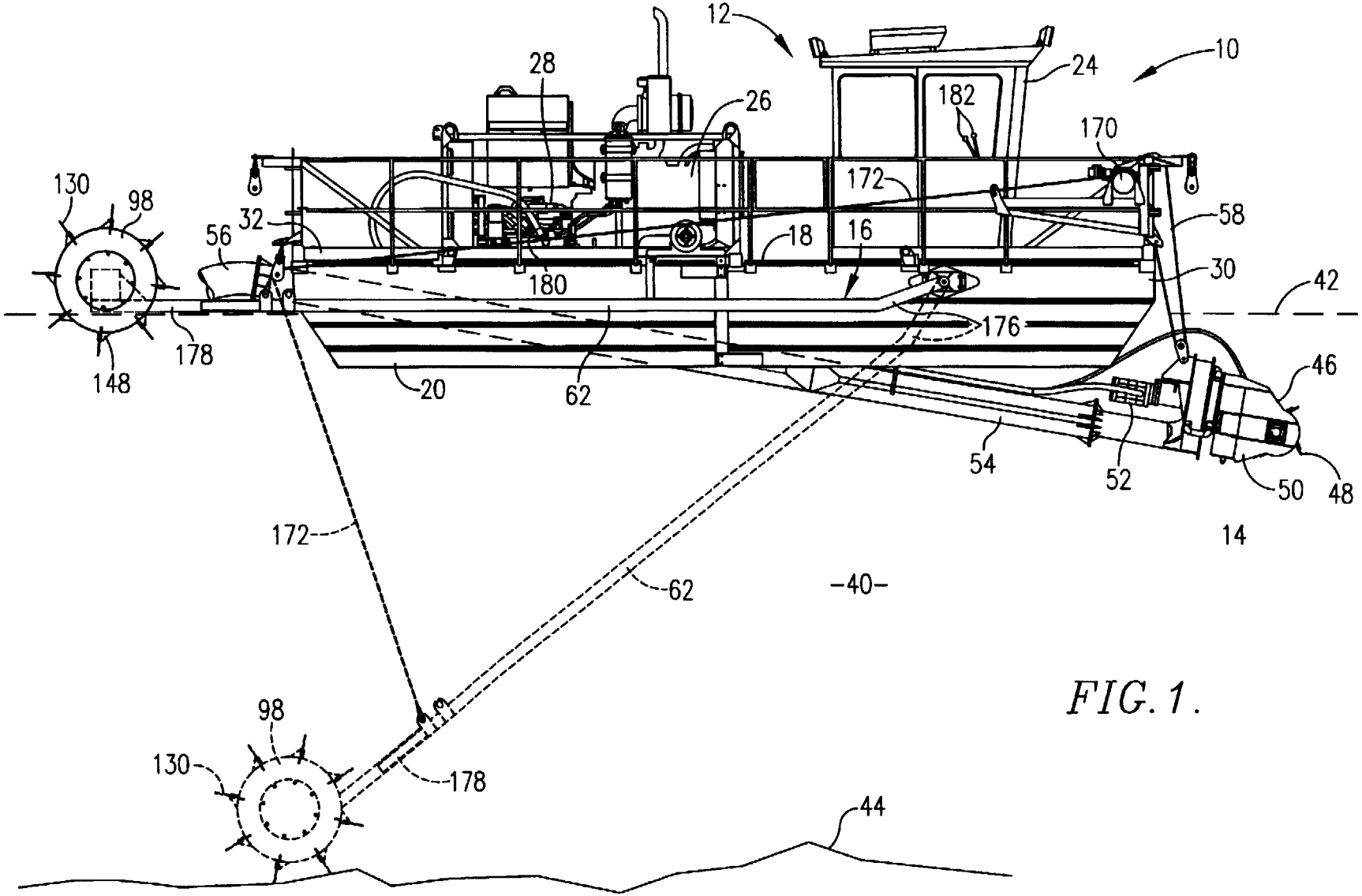
FIG. 1 is a right side elevational view of the watercraft propulsion system hereof, with the left side being substantially a mirror image thereof, and with the starboard boom shown in phantom in a lowered position with the wheel engaging the bottom of the waterway.

Referring now to the drawings, a watercraft propulsion system 10 embodying the present invention broadly includes a watercraft 12 carrying a pumping unit 14 and a propulsion unit 16.

The watercraft 12 preferably has deck 18 which spans twin port and starboard hulls 20*a* and 20*b*. An alleyway 22 is defined between the hulls and below the deck 18. The deck 18 carries the wheel house 24 which includes controls for the pumping unit 14 and the propulsion unit 16. The control for the propulsion unit 16 is preferably a joystick-type control. A diesel engine 26 supplies power for the pumping unit 14 and the propulsion unit 16 by a pressure compensated, load sensing, variable displacement piston hydraulic pump 28. An exemplary hydraulic pump 28 found useful with the present invention is made by Parker Pumps as model number PAVC 65. Such a pump 28 is especially useful in providing the bulk of the power required to operate both the pumping unit 14 and the propulsion unit 16 and is capable of providing up to twenty gallons per minute of hydraulic fluid at up to 2400 pounds per square inch pressure and quick responsiveness in accelerating the flow from zero to twenty gallons per minute at the operating pressure. The watercraft 12 presents a bow 30, a stern 32, a port side 34 and a starboard side 38. It is designed for use as a dredge or for harvesting aquatic weeds, and in that regard is used on a waterway 40 presenting a surface 42 and a bottom 44.

The pumping unit 14 includes a cutterhead 46 mounting a rotatable cutter 48 within a shroud 50, a pump 52 which receives liquid and solid material through an opening in the shroud 50, a discharge pipe 54 fluidically connected to the outlet side of the pump 52, and a hose 56 which may have a typical diameter of eight inches or more for delivering material to a barge or shore-based dewetting location. The pipe 54 is preferably positioned in the alleyway between the hulls 20*a* and 20*b* and pivotally mounted to the watercraft 12 at the stern 32. A winch, cable and pulley assembly 58 is provided for raising and lowering the cutterhead 46 as desired for dredging or harvesting weeds from the surface 42. An exemplary cutterhead 46 for use in the presenting invention is shown in U.S. Pat. No. 5,481,856, the disclosure of which is incorporated herein by reference.

Figure 2:
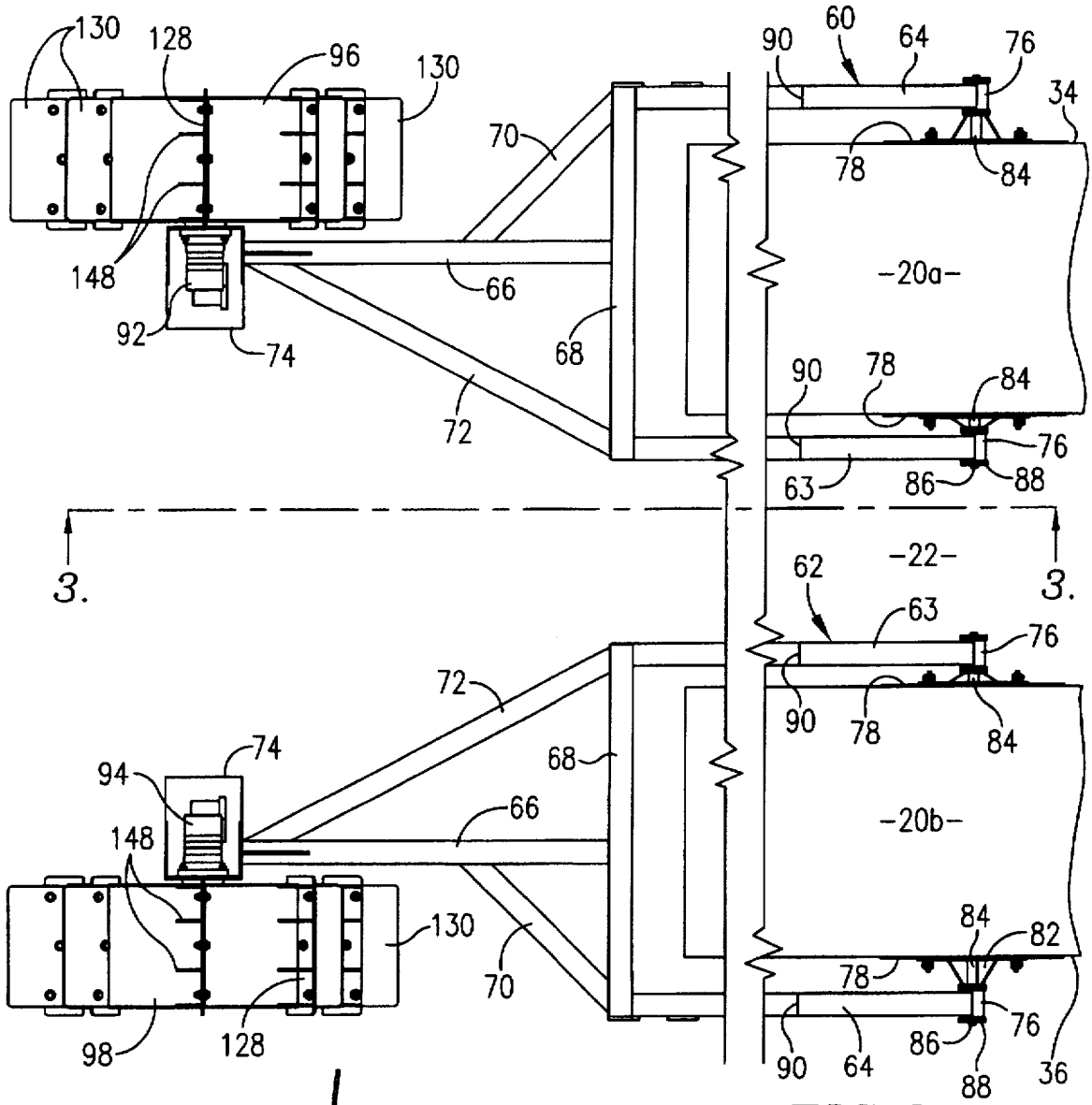
FIG. 2 is an enlarged, fragmentary sectional view of the aft section of the watercraft taken through the port and starboard hull sections just below the deck, showing the mounts carrying the booms.
Figure 3:
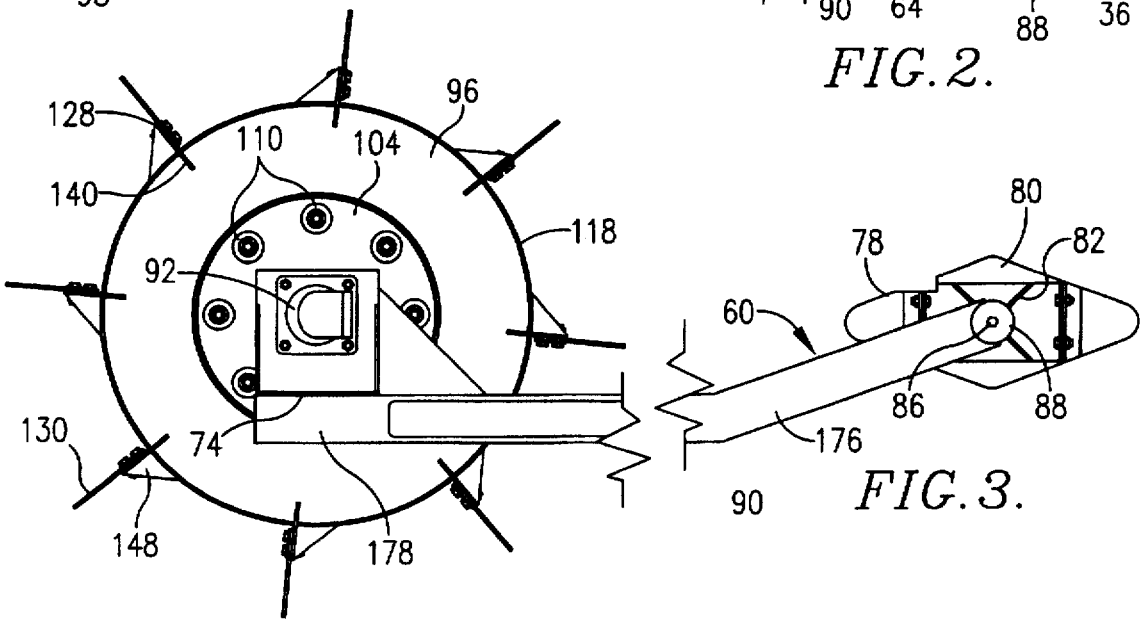
FIG. 3 is an enlarged fragmentary side elevational view of the port boom and wheel with the port hull section removed for clarity.

The propulsion unit 16 includes trailing port and starboard booms 60 and 62 as shown in FIGS. 1 and 2. Port boom 60 and starboard boom 62 are essentially mirror images of one another, each including inboard arm 63, outboard arm 64, aft arm 66, crossbar 68, outer brace 70, inner brace 72 and motor carrier 74. The inboard arm 62 of each boom 60 and 62 include respective cylindrical bearings 76 which are pivotally coupled to their respective hull 20*a*, 20*b* by mounting members 78. Mounting members 78 each include backing plate 80, gusset plates 82, and trunnions 84 which extend perpendicular to the longitudinal axis defined by the hulls. A retaining bolt 86 secures a face plate 88 to hold the bearings 76 of the booms on the trunnions. As may be seen in FIGS. 1, 2 and 3, the booms 60 and 62 include an elbow 90 on the forward portion of the inboard arm 62 and the outboard arm 64 to enhance the ability to position each boom to its fully raised position.

Figures 4, 5, 6, 7, 8:
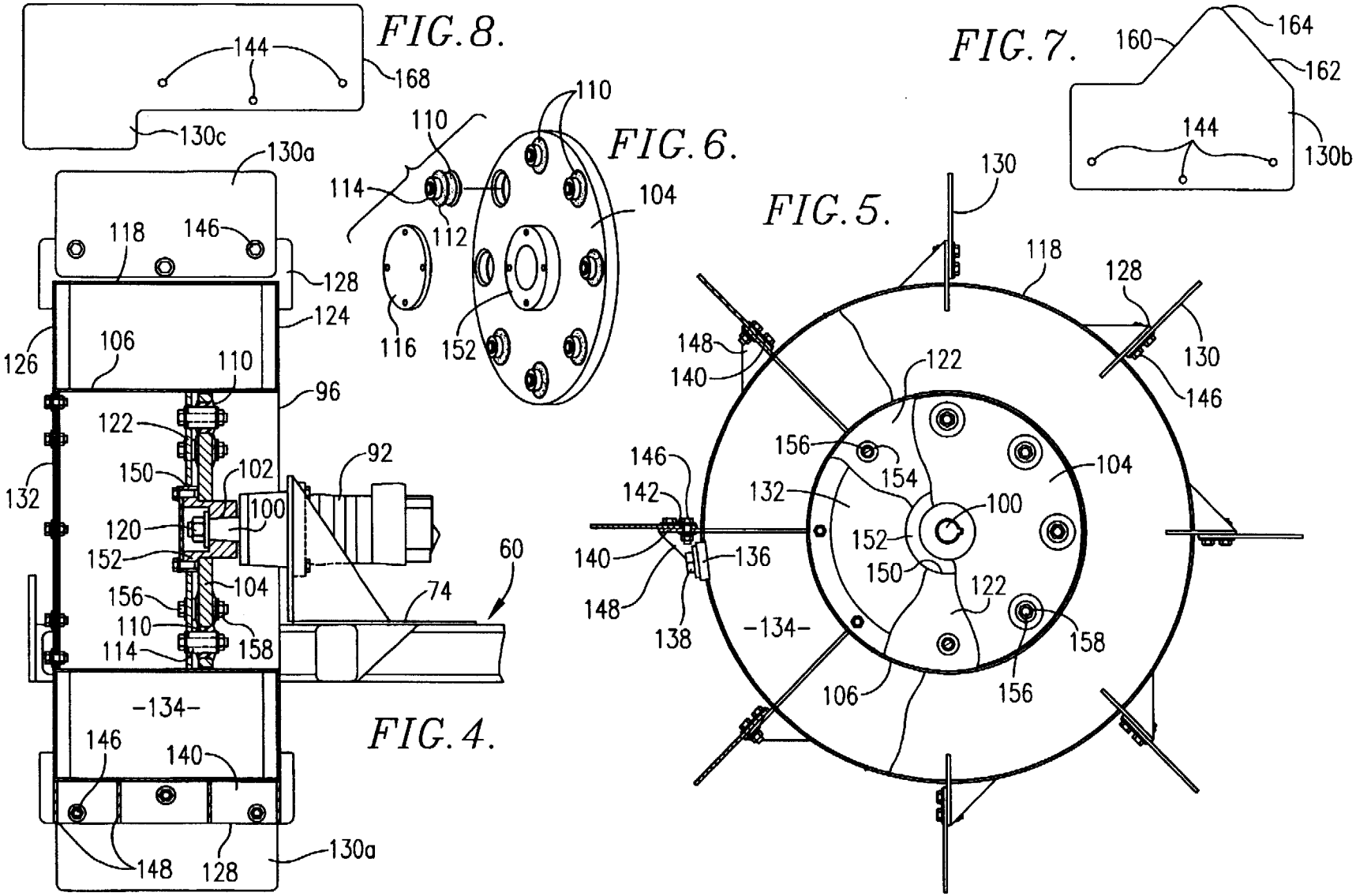
FIG. 4 is an enlarged, fragmentary vertical cross-sectional view of the port side wheel and drive motor, showing the hub and buoyancy chamber on the wheel.
FIG. 5 is a left side elevational view in partial section of the wheel shown in FIG. 4, showing the shock absorbing couplings.
FIG. 6 is a partially exploded perspective view of the outboard side of the wheel hub for coupling the motor to the wheel.
FIG. 7 is an alternative blade configuration for mounting to the wheel used in the system hereof and presenting a penetrating point.
FIG. 8 is a second alternative blade configuration presenting a greater breadth than the rim of the wheel for enhanced surface propulsion.

The motor carrier 74 of each boom 60, 62 mounts a respective hydraulically driven reversible motor 92, 94. Each motor 92 is fluidically connected to the main hydraulic pump 28 by hydraulic fluid conduits for supplying hydraulic fluid under pressure. Each motor 92 is preferably of a Grotor type having high-torque, low speed reversible capability and also known as a hydraulic wheel motor for supplying driving power to port and starboard wheels 96, 98. A useful motor for this application is manufactured by Charlynn and is rated at thirty horsepower. FIGS. 4 and 5 show the arrangement and mounting of the port wheel 96, with the arrangement and mounting of the starboard wheel 98 being substantially identical. Each of the motors 92, 94 includes a keyed shaft 100 which is received into an opening 102 in a hub 104 and defines an axis of rotation for each wheel 96, 98. The hub 104 is dislike in configuration, sized to be received within the inner rim 106 of the wheel 96, 98 and presents a plurality of circumferentially spaced holes 108. Each of the holes is sized to receive a shock absorbing coupling 110 which includes a resilient sleeve 112 and rigid metallic bushing 114. An exemplary coupling 110 useful in accordance with the invention is manufactured by Lord Corporation, Industrial Products Division under the trademark Dynaflex. The hub 104 is provided with a cap 116 secured over the opening 102 to protect the shaft 100. The only contact between the wheel 96, 98 is through the couplings 110 which permit limited torsional flexibility between the motor and its corresponding wheel to minimize torsional shock on the wheel or the motor. The shafts 100 are further threaded and held in position by a nut 120.

Each wheel 96, 98 includes an outer rim 118, the inner rim 106, an annular disk 122 coupled to the inner rim 120, inboard wall 124 and outboard wall 126, a plurality of circumferentially spaced blade mounts 128 on the outer rim 118, and a blade 130 removably mounted to each blade mount 128. A cover plate 132 is mounted by bolts or other threaded fasteners on the outboard side of the wheel 96, 98 to protect against the intrusion of weeds, grit or other material which interferes with rotation of the wheel. The outer rim 118, inner rim 120, inboard wall 124 and outboard wall define therein an enclosed buoyancy chamber 134 which provides a buoyancy force to at least partially offset the weight of the wheel, motor and boom when submerged or resting on the surface of the waterway. An access opening 136 and plug 138 may be provided in the outer rim 118 to provide access to drain the chamber 134 if leakage develops.

The blade mounts 128 include a radially extending, transversely oriented blade wall 140 which presents a plurality of holes 142 which are complimentary configured to align with holes 144 on corresponding blades 130 and receive therethrough bolts 146 or other removable fasteners for removably securing blades 132 wheel. Each blade mount 128 further includes a plurality of radially projecting gusset plates 148 oriented perpendicular to the axis of rotation of the wheel 96,98 and innerconnecting the wall 140 with the outer rim 118. The gusset plates 148 aid in resisting deformation of the wall 140 and also serve to inhibit movement of the watercraft 12 in a direction including a component along the axis of the rotation of the wheel due to wind, current, or the like. The plates 140 are also aligned with radially extending reinforcing walls extending between the inner rim 120 and the outer rim 118 and which provide an enhanced structural support for the wheel 96,98. Disk 122 is annular in configuration and preferably welded about its inner circumference to the inner rim 120. Disk 122 has a central aperture 150 presenting a diameter greater than the outer diameter of an extension 152 on hub 104 to provide a clearance therebetween. Disk 122 further presents a plurality of circumferentially spaced holes 154 positioned for alignment with the shock absorbing couplings 110 whereby the disk 122 may be mounted to the couplings 110 by threaded fasteners such as bolts 156 and nuts 158.

Blades 130 may be provided in alternate configurations for different environments of operation. FIG. 4 illustrates a typical blade 130*a* used for ordinary operations in sand or sediment where the blade 130*a* will achieve normal penetration into the bottom of the waterway. FIG. 7 illustrates blade 130*b* which may be mounted for substitution of blade 130*a* where conditions on the bottom are more dense or require greater penetration. Blade 130*b* includes a pair of diagonally oriented radially extending edges 160,162 converging on point 164. Thus, the point may offer greater penetration than the normally horizontally extending blade edge 166 of blade 130*a*. A further alternative blade design is shown as blade 130*c* of FIG. 8. Blade 130*c* presents an outer edge 168 having a greater transverse width and thus correspondingly greater surface area than either blade 130*a* or 130*b*. Blade 130*c* may be substituted on wheels 96,98 when the bottom of the waterway is soft and the watercraft will more often be driven using the wheels 96,98 as paddle wheels as illustrated as solid lines in FIG. 1.

The booms 60,62 may be independently raised and lowered by the use of winches 170 receiving lift cables 172 passing through pulleys 174. The booms 60,62 each include a proximate end 176 and a remote end 178, with the end of the cable 172 opposite the winch 170 being coupled proximate the remote end 178. Separate winches 170 are provided for each boom 60,62 so that one boom can be raised for surface propulsion as shown in solid lines in FIG. 1, whereas the other boom may be lowered into bottom-engaging position as shown in dotted lines in FIG. 1.

The hydraulic pump 28 is preferably connected to a valving unit 180 which includes a minimum of six electronically controlled proportional valves whereby individual valves are connected to motors 92 and 94, each of the two winches 170, the winch of the winch, cable and pulley assembly 58 for raising and lowering the cutterhead 46, and the pump 52. The individual valves are pulsed with modulated control whereby upon receiving greater voltage, the valves provide a greater opening to increase hydraulic power. The valves operating the motors 92, 94 are preferably individually controlled by a pair of joysticks 182 whereby increased power in either forward or reverse direction may be supplied to independently drive the wheels 96, 98.

In operation, the watercraft 12 is preferably placed in a shallow waterway 40 having regions of limited depth whereby the booms 60, 62 may be lowered into engagement with the bottom 44. The cutterhead 46 is maintained in a raised position while the propulsion unit 16 moves the watercraft 12 into operating position. This may be accomplished with the booms 60 and 62 in the raised position shown in solid lines in FIG. 1, whereby the motors 92, 94 turn their respective wheels 96, 98 with only the lowermost blades 130 below the surface 42. The rate of rotation and direction of rotation of each wheel 96, 98 is independently controlled by joysticks 182, with one of the joysticks 182 operatively controlling the respective valves of the valving mechanism 180 for each motor 92, 94. Thus, the watercraft propulsion system 10 operates as a stern drive paddlewheel vessel with two independently driven paddlewheels in this mode of operation. To turn the watercraft 12 in this mode, one of the joysticks 182 is moved forward greater than the other. Thus, to turn to starboard, the joystick 182 controlling the valving of drive motor 92 is advanced a greater distance than the joystick controlling the valving of drive motor 94, so that more power (and therefor more revolutions) are provided to wheel 96 than wheel 98. Further, the craft 12 can be turned more rapidly by pushing the two joysticks in opposite directions, whereby one of the drive motors is providing turns for forward movement (clockwise as shown in FIG. 1), while the other drive motor is providing turns for rearward movement (counterclockwise as shown in FIG. 1).

To move the watercraft 12 by engaging the bottom 44 of the waterway 40, the winches 170 are activated to lower the booms 60, 62 until the blades 130 of wheels 96, 98 are in contact and penetrate into the bottom 44. The joysticks 182 are then operated as indicated previously to propel and position the watercraft 12. If desired, the booms 60, 62 may depend freely without tension applied by cable 172 so that the wheels 96, 98 track along the contours of the bottom 44. The width of the outer rims 118 are preferably one foot or more to avoid sinking of the wheels into the bottom, and this is further aided by the buoyancy provided by buoyancy chamber 134. Again, the motors 92, 94 may be driven independently in the same or opposite directions at the same or different speeds for effective propulsion and maneuvering. Moreover, the gusset plates 148 may aid in limiting lateral movement on soft bottoms 44 due to current or wind conditions. As operating conditions change, different blade configurations 130*a*, 130*b* or 130*c* may be used to provide the most effective and efficient penetration or surface operating characteristics.

One particular advantage of the present system is the ability to maintain and maneuver the craft 12 during use of the pumping unit 14. Significant propulsive force may be required to hold the position of the watercraft 12 against the reactive forces of the cutterhead 46 and hose discharge. Thus, whether harvesting aquatic weeds or dredging sediment in ponds or channels, the ability to achieve positive engagement between the wheels 96, 98 and the bottom 44 provides improved resistance to movement of the watercraft away from the weeds or material to be dredged when compared to conventional surface propulsion. However, the present system also permits the watercraft 12 to transit regions of the waterway of a depth greater than the effective contact reach of the booms and wheels, and to recover and transit across deep holes of the waterway. In addition, the propulsive arrangement of the wheels 96, 98 when in a raised position resists clogging by weeds and is readily maintainable in harsh environments, and in many applications may provide sufficient propulsive effort to maintain the position of the watercraft during operation of the pumping unit 14.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of their invention as pertains to any apparatus not materially departing from but outside the liberal scope of the invention as set out in the following claims.

We claim:

1. A watercraft propulsion system for moving a watercraft along a shallow waterway having a bottom and a surface comprising:

a watercraft presenting a port side and a starboard side;

a first boom presenting a proximate end and a remote end;

a second boom presenting a proximate end and a remote end;

first and second mounting members connected to the side of the watercraft and pivotally mounting the proximate end of the respective first and second booms along the respective port and starboard sides of the watercraft;

a first wheel mounted to said first boom for rotation about a first axis located proximate said remote end of said first boom, said first wheel including a plurality of radially extending, circumferentially spaced blades;

a second wheel mounted to said first boom for rotation about a second axis located proximate said remote end of said second boom, said second wheel including a plurality of radially extending, circumferentially spaced blade;

a first drive motor operatively connected to said first wheel for bidirectional rotational driving of said first wheel;

a second drive motor operatively connected to said second wheel for bidirectional rotational driving of said second wheel;

means mounted on said watercraft for raising and lowering said first boom between a lowered position with the first wheel in engagement with the bottom of the waterway and a raised position with the first wheel in contact with the surface of the waterway;

means mounted on said watercraft for raising and lowering said second boom independently of said first boom between a lowered position with the second wheel in engagement with the bottom of the waterway and a raised position with the second wheel in contact with the surface of the waterway.

2. The system of claim 1, further including a pipe, a pump having an intake and a discharge and mounted on the pipe, and a rotatably mounted cutterhead connected to said pipe adjacent said inlet, wherein said first and second boom extend along said port and starboard sides from said first and second mounting members away from said cutterhead.

3. The system of claim 2, including a circumferentially extending rim located on each of said first and second wheels radially outwardly from said axis of rotation, said rim presenting a plurality of blade mounts thereon including blade couplers individually and removably mounting each of said blades to a respective blade mount.

4. The system of claim 3, wherein each of said blade mounts includes a radially extending plate oriented substantially perpendicular to the axis of rotation of the respective first or second wheel.

5. The system of claim 4, wherein each of said blade mounts includes a radially extending wall oriented perpendicular to said plate, said wall including a plurality of apertures for receiving therethrough respective ones of said blade couplers.

6. The system of claim 3, wherein at least one of said blades on at least one of said first and second wheels present radially outwardly extending convergent edges defining a point.

7. The system of claim 2, including structure defining a circumferentially extending, enclosed buoyancy chamber on each of said first and second wheels inboard of said blades.

8. The system of claim 2, including a first hub interconnecting said first wheel and said first drive motor and a second hub interconnecting said second wheel and said second drive motor, said first and second hubs each including a plurality of shock absorbing mounts for connecting said wheel to said hub.

9. The system of claim 8, said shock absorbing mounts including a resilient bushing and a threaded connector.

10. The system of claim 1, wherein each of said first and second drive motor includes a hydraulic motor mounted adjacent said remote end respectively of said first and second booms.

11. The system of claim 1, wherein said first and second raising and lowering means includes first and second winch and a cable assemblies respectively mounted to said watercraft and connected adjacent the remote end of each of said first and second booms.

* * * * *